US006409318B1

(12) United States Patent
Clark

(10) Patent No.: US 6,409,318 B1
(45) Date of Patent: Jun. 25, 2002

(54) FIRING CHAMBER CONFIGURATION IN FLUID EJECTION DEVICES

(75) Inventor: Garrett E. Clark, NW Albany, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/727,823

(22) Filed: Nov. 30, 2000

(51) Int. Cl.[7] ..... B41J 2/05; B41J 2/17
(52) U.S. Cl. ..... 347/65; 347/94
(58) Field of Search ..... 347/63, 65, 67, 347/94, 48, 15, 44, 47

(56) References Cited

U.S. PATENT DOCUMENTS

| | | | | |
|---|---|---|---|---|
| 4,353,079 A | | 10/1982 | Kaw anabe | 347/43 |
| 4,646,110 A | * | 2/1987 | Ikeda et al. | 347/48 |
| 4,680,859 A | | 7/1987 | Johnson | 29/611 |
| 4,746,935 A | | 5/1988 | Allen | 347/15 |
| 4,847,630 A | | 7/1989 | Bhaskar | 347/63 |
| 5,167,776 A | | 12/1992 | Bhaskar | 205/75 |
| 5,208,605 A | * | 5/1993 | Drake | 347/15 |
| 5,350,616 A | | 9/1994 | Pan et al. | 347/63 |
| 5,519,403 A | | 5/1996 | Moritz, III | 347/65 |
| 5,519,423 A | * | 5/1996 | Moritz, III et al. | 347/65 |
| 5,521,622 A | | 5/1996 | Hock | 347/43 |
| 4,746,965 A | | 5/1998 | Nishi | 257/210 |
| 5,940,096 A | * | 8/1999 | Komplin et al. | 347/94 |
| 6,010,208 A | * | 1/2000 | Powers et al. | 347/65 |
| 6,042,222 A | | 3/2000 | Moritz, III | 347/65 |

OTHER PUBLICATIONS

U.S. application No. 09/335,858, filed Jun. 17, 1999.

* cited by examiner

*Primary Examiner*—John Barlow
*Assistant Examiner*—Juanita Stephens

(57) ABSTRACT

An ink-jet printhead is designed with different sets of firing chamber configurations on the same printhead. One set of firing chambers provides for relatively large-volume drops and rapid refill times to facilitate draft-mode printing. A second set of firing chambers provides smaller drop volumes and more controlled refill rates that are optimized for high-quality printing.

21 Claims, 2 Drawing Sheets

FIRING CHAMBER CONFIGURATION IN FLUID EJECTION DEVICES

TECHNICAL FIELD

This invention relates to the construction of ink drop ejector components of printheads used in ink-jet printing.

BACKGROUND OF THE INVENTION

An ink-jet printer typically includes one or more cartridges that contain ink. In some designs, the cartridge has discrete reservoirs of more than one color of ink. Each reservoir is connected via a conduit to a printhead that is mounted to the body of the cartridge.

The printhead is controlled for ejecting minute drops of ink from the printhead to a printing medium, such as paper, that is advanced through the printer. The printhead is usually scanned across the width of the paper. The paper is advanced, between printhead scans, in a direction parallel to the length of the paper. The ejection of the drops is controlled so that the drops form recognizable images on the paper.

The ink drops are expelled through nozzles that are formed in a plate that covers most of the printhead. The nozzle plate is typically bonded atop an ink barrier layer of the printhead. That barrier layer is shaped to define ink chambers. Each chamber has adjacent to it a nozzle through which the ink drops are expelled.

Ink drops are expelled from an ink chamber by a heat transducer, which typically comprises a thin-film resistor. The resistor is carried on an insulated substrate, such as a conventional silicon die upon which has been grown an insulation layer, such as silicon dioxide. The resistor is covered with suitable passivation and cavitation-protection layers, as is known in the art and described, for example, in U.S. Pat. No. 4,719,477, hereby incorporated by reference.

The resistor has conductive traces attached to it so that the resistor can be selectively driven (heated) with pulses of electrical current. The heat from the resistor is sufficient to form a vapor bubble in an ink chamber, the rapid expansion of which propels a drop through the adjacent nozzle.

The chamber is refilled after each drop ejection with ink that flows into the chamber through a channel that connects with the conduit of reservoir ink. The components of the printhead (such as the heat transducer and ink chamber) for ejecting drops of ink are oftentimes referred to as drop ejectors. The action of ejecting a drop of ink is sometimes referred to as "firing" the resistor or drop ejector. The ink chambers are hereafter referred to as firing chambers.

Print quality is generally improved when one can precisely control the volume of the individual ink drops that are expelled from the printhead. In this regard, it is important to ensure that the drop volume does not uncontrollably change from one drop to the next. Also, as a general rule, the smaller the volume of expelled drops, the higher the print quality.

As noted, the refill ink rapidly flows into the chamber after each printhead firing. This behavior of the refill ink can be characterized as a wave action in which refill ink initially surges into the chamber and then backflows slightly. This cycle is repeated in diminishing magnitude until the ink in the chamber is sufficiently quiescent for firing the next drop. The chamber and channel leading to it are designed to provide passive damping of the refill ink to shorten the time required to reach the quiescent condition.

For high quality printing, it is important that the refill process is damped to an extent that no "overshooting" or "undershooting" occurs. Overshooting occurs when the volume of ink in the firing chamber is greater than a quiescent or steady state volume. Firing at such time causes a relatively larger drop to be ejected. Undershooting occurs when the volume of ink in the firing chamber ebbs below the steady state volume. Firing at such time causes a relatively smaller drop to be ejected. As noted, such uncontrolled changes in drop volume will have deleterious effects on print quality.

In view of the foregoing, it will be appreciated that chamber refill times can be limiting factors as respects the overall printing speed or throughput of the printer. That is, the frequency with which the firing chamber can be refilled and the refill-ink sufficiently damped limits the frequency with which uniform-volume drops can be expelled.

Most printers permit at least two print modes: draft and high-quality. Draft modes sacrifice print quality (by permitting some overshooting, for example) in exchange for faster throughput. A draft mode of printing may allow firing of the printheads at frequencies as much as four times faster than high-quality mode.

Despite the availability of two print modes, the conventional use of a single firing chamber configuration for both modes means that the printhead designer must select a compromise configuration for the firing chamber. That compromise design is one that, while permitting relatively high-frequency draft mode, must still passively dampen (hence, slow) the flow of refill-ink to the firing chamber to allow uniform-volume printing in high-quality mode at a reasonable printing speed.

SUMMARY OF THE INVENTION

The present invention frees the designer from the design compromise just mentioned by providing on the same printhead two different firing chamber configurations. One set of firing chambers provides large-volume drops, and rapid refill times to facilitate draft-mode printing. A second set of firing chambers provides smaller drop volumes and more controlled refill rates that are optimized for high-quality printing.

As another aspect of this invention, the two sets of chambers are aligned in a manner that permits high resolution printing in both draft and high-quality mode.

The present invention also permits the nozzle configurations for each firing chamber to be optimized for the print mode that is carried out by that particular firing chamber. Also, the draft-mode-dedicated nozzles require much less intermittent servicing, which is automatically performed by a service station that is installed in the printer. As a result, draft mode operation is less often interrupted for servicing as compared to the high-quality mode operation, which produces better drop configurations but requires more frequent servicing.

Apparatus and methods for carrying out the invention are described in detail below. Other advantages and features of the present invention will become clear upon review of the following portions of this specification and the drawings.

DETAILED DESCRIPTION OF PREFERRED EMBODIMENTS

Figure 1:
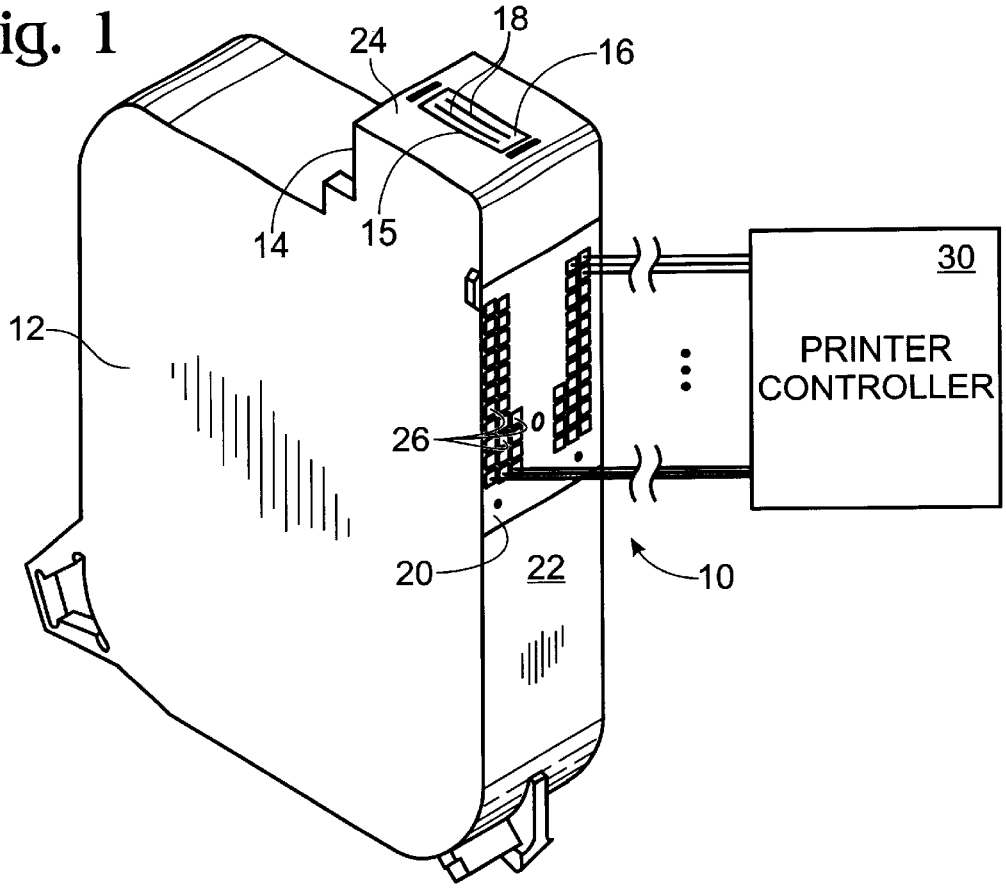
FIG. 1 is a perspective view of an ink-jet printer cartridge having a printhead that incorporates the print-mode specific firing chamber configurations of the present invention.

FIG. 1 illustrates an ink-jet printer cartridge 10 (shown inverted from its normal, installed position in a printer) that includes a plastic body 12 that defines a reservoir for ink. The cartridge body 12 is shaped to have a downwardly extending snout 14. A printhead 15 is attached to the underside of the snout 14. The exposed portion of the printhead is the exterior surface of a rectangular nozzle plate 16 that includes minute nozzles 18 (in this instance, two rows of nozzles) from which are ejected ink drops onto printing medium that is advanced through the printer, very near the nozzle plate 16.

A thin circuit 20 is attached to the body 12 of the cartridge 10, partly on one side 22 of the cartridge. Part of the circuit, which is flexible before attachment, continuously extends from the side 22 across most of the underside 24 of the snout 14. That part of the circuit extends next to, but does not cover, the nozzle plate 16. The circuit 20 may be a thin polyimide material that carries conductive traces. The traces connect at one end to contact pads in the printhead 15 that are near the long edges of the nozzle plate 16. The other ends of the traces terminate in contact pads 26 on the circuit, which pads mate with corresponding pads on a carriage (not shown).

In short, the circuit 20 carries control signals from the microprocessor-based printer controller 30 to the individual components in the printhead 15 (primarily the heat transducers) that produce the ink drop ejection through the nozzles 18 of the nozzle plate 16.

Figure 2:
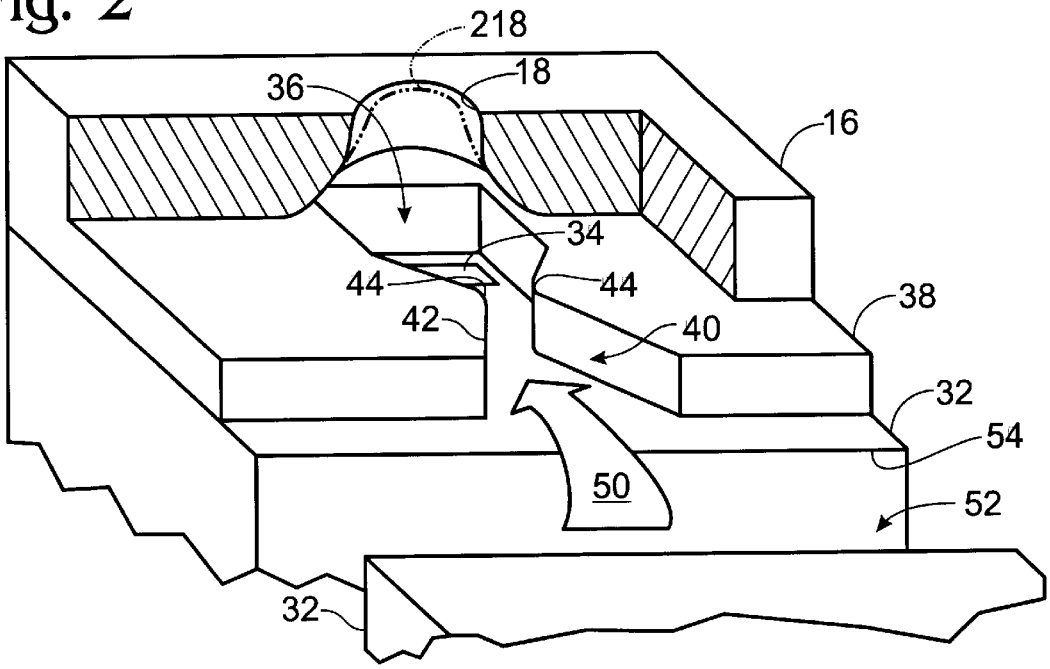
FIGS. 2 is a cutaway view of a portion of a printhead drop injector for illustrating the primary components of the present invention.

The greatly enlarged cutaway view of FIG. 2 illustrates in perspective view a single firing chamber and associated nozzle of a printhead. In particular, the printhead comprises a substrate 32, such as a conventional silicon die upon which has been grown an insulation layer, such as silicon dioxide.

A thin-film resistor 34 is formed on the substrate and is covered with suitable passivation and cavitation-protection layers, as is known in the art. A patterned layer of electrically conductive material separately conducts the above-mentioned current pulses to the resistor 34 for heating the resistor and vaporizing ink in the firing chamber 36. Two exemplary conductive members 35 are shown in dashed lines in FIG. 3. The associated ground or return conductive members are not shown.

The shape of an individual firing chamber 36 is primarily defined by a barrier layer 38, which is made from photosensitive material that is laminated onto the printhead substrate 32 and then exposed, developed, and cured in a configuration that defines the firing chamber 36. The barrier layer also defines an ink inlet channel 40 to each chamber. Each channel 40 includes sidewalls 42 that converge to define a pinch point or restriction portion 44 as discussed more below.

Ink drops are ejected through a nozzle 18 (one of which is shown cut away in FIG. 2) that is formed in the above mentioned nozzle plate 16 that covers most of the printhead 15. The nozzle plate 16 may be made from electrodeposited metal or a laser-ablated polyimide material. The nozzle plate 16 is bonded to the barrier layer 38 and aligned so that each firing chamber 36 is continuous with one of the nozzles 18 from which the ink drops are ejected.

As the ink in the chamber 36 is vaporized, the resultant expansion of that fluid forces a drop out the chamber 36 through the adjacent nozzle 18, which is directly above and centered on its associated firing chamber 36.

The pressure drop attributable to the departure of a fired ink drop draws refill ink through the channel 40 and into the temporarily empty chamber 36. In the presently preferred embodiment, refill ink (generally depicted as arrow 50) flows from the cartridge reservoir from an ink feed slot 52 formed in the substrate 32 of the printhead and across an edge 54 of the feed slot into the channel.

FIG. 2 depicts one exemplary firing chamber 36 that is next to a feed slot 52 that is formed in the center of the printhead substrate 32. Other firing chambers of such an embodiment are located on the same and opposing side of the center feed slot 52 such that the channels of all the firing chambers of the printhead open to the central ink-feed slot of the printhead. In other preferred embodiments, the refill ink may flow over a side edge of the printhead so that the channels of the chambers open to the sides of the printhead. In either case, the edge, such as center-feed edge 54, is a linear margin of the location where the refill ink flows over the substrate 32 on its way into the channel 40.

The refill ink 50 flows between the channel sidewall 42 and through the restriction portion 44 of the channel on its way to fill the chamber. As noted above, the channel configuration, and particularly its restriction portion, act as passive components for damping the wave action of the refill ink so that the refill ink relatively quickly reaches a quiescent state in the ink chamber in readiness for expulsion of the next drop.

The firing chamber, and the ink channel shape and orientation of conventional printheads, while permitting ink flow rates for relatively high-frequency draft mode, must still passively dampen (hence, slow) the flow of refill-ink to the firing chamber to allow that same firing chamber to provide uniform-volume drops required for printing in high-quality mode at a reasonable printing speed.

The present invention provides two different sets of firing chambers. One set of firing chambers provides relatively large-volume drops and rapid refill times to facilitate draft-mode printing. A second set of firing chambers provides smaller drop volumes and more controlled refill rates that are optimized for high-quality printing. The heat transducers are independently operable so that the draft-mode set of firing chambers can be used exclusively for draft mode and the high-quality set of firing chambers can be used exclusively for high-quality mode printing.

Figure 3:
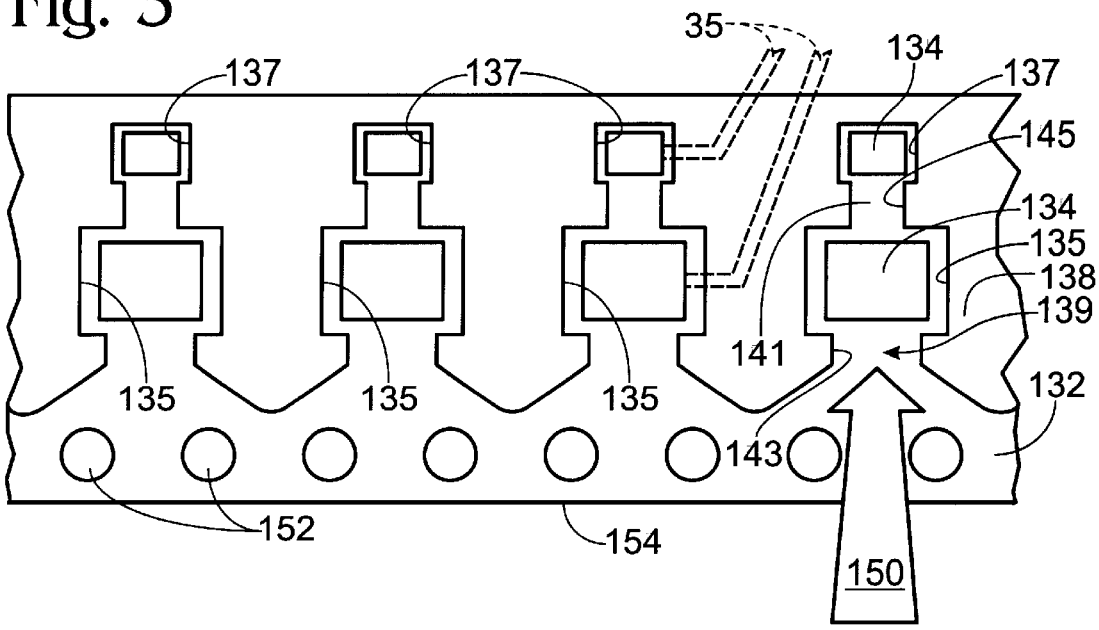
FIG. 3 is a top view, cross sectional diagram of one embodiment of the firing chambers of the present invention.

FIG. 3 depicts one preferred embodiment of the present invention. This figure is a top view of a printhead with the nozzle plate removed to depict the configuration of the underlying firing chambers and associated channels. FIG. 3 shows a representative four groups of the many firing chambers carried on the printhead.

In particular, the embodiment of FIG. 3 shows a printhead substrate 132 generally matching the above-described substrate 32 and including an edge 154 across which refill ink 150 flows to each chamber in a direction generally perpendicular to that edge. The barrier layer 138 is shaped to define a first (draft-mode) firing chamber 135 and a second (high-quality-mode) firing chamber 137. It will be appreciated that for the purposes of this description the details of only one draft-mode firing chamber and one high-quality-mode firing chamber will be offered with the understanding that the details apply to all of the several chambers (and channels) of the sets of draft-mode and high-quality-mode firing chambers.

The draft-mode firing chamber 135 is substantially larger than the high-quality-mode firing chamber 137. In this embodiment, the draft-mode firing chamber 135 is about three times larger in volume than the high-quality-mode firing chamber 137. Also, the ink channel 139 opening directly into the draft-mode firing chamber 135 is designed to facilitate rapid refilling of that chamber 135. In this regard, the restriction portion 143 of that channel is relatively large (as compared to the restriction portion 145 of the channel 141 opening into the high-quality-mode firing chamber 137, discussed below).

Rapid refill of the draft-mode firing chamber 135 is enhanced by locating that firing chamber 135 relatively close to the edge 154, thereby to shorten the distance that the ink must flow into that chamber.

Whenever fast or draft mode printing is desired, only the heat transducers associated with the set of draft-mode firing chambers 135 are operated and, owing primarily to the rapid refill time, a very high printing speed is achieved. Also, the relatively large drop volume and high frequency firing of this mode reduces the frequency with which the printhead must be serviced (such as, for example, by temporarily halting printing while the nozzle plate surface is automatically wiped at a service station in the printer body). This reduction of service requirements increases printer throughput (measured, for example, in pages per minute) for draft-mode printing.

Whenever high-quality-mode printing is required, only the heat transducers associated with the set of high-quality-mode firing chambers 137 are operated. The relatively smaller firing chamber volume 137 and substantial passive damping provided by the channel 141 and its restriction portion 145 respectively provide relatively small-volume ink drops and ink refill damping for permitting high-quality print mode.

The optional spaced-apart circular (in cross section) posts 152 formed of the barrier layer material near the edge 154 of the substrate 132 serve to screen particulates and to provide support for the nozzle plate above the surface of the substrate in the vicinity of the edge 154 where there is otherwise no such supportive barrier layer material. The posts 152 are circular so as to minimize interference with the flow of ink around them. As noted, such posts are optional and not required for practice of the present invention.

In the embodiment of FIG. 3, each draft-mode firing chamber 135 is in direct fluid communication with a high-quality-mode firing chamber 137 and aligned so that the refill ink 150 flows in a linear path from the edge 154 to the high-quality-mode firing chamber 137. Thus, this embodiment promotes the efficient flow of ink to firing chambers and allows close spacing between adjacent firing chambers of the same sets (that is, spacing as viewed from left to right in FIG. 3, normal to the scanning direction of the printhead) to permit high-resolution printing measured, for example in drops per inch. It is noted however, that the high-quality-mode firing chambers 137 could be angled somewhat from the linear path.

It is contemplated that the firing chamber arrangements of the embodiment of FIG. 3 could be used in other ways than exclusively draft-mode printing or high-quality mode printing. In this regard, the heat transducers of both sets of firing chambers 135, 137 could be selectively operated in the same printing task. For instance, the two different chambers could be spaced close enough together to provide an acceptable resultant drop on the print media when both firing chambers are simultaneously employed. Also, for one particular target pixel in the scanning direction (the vertical direction in FIG. 3) the printer controller is provided with a selection of one of two quite different drop volumes associated with each chamber. In short, this design provides a multiple drop-volume printhead.

Figure 4:
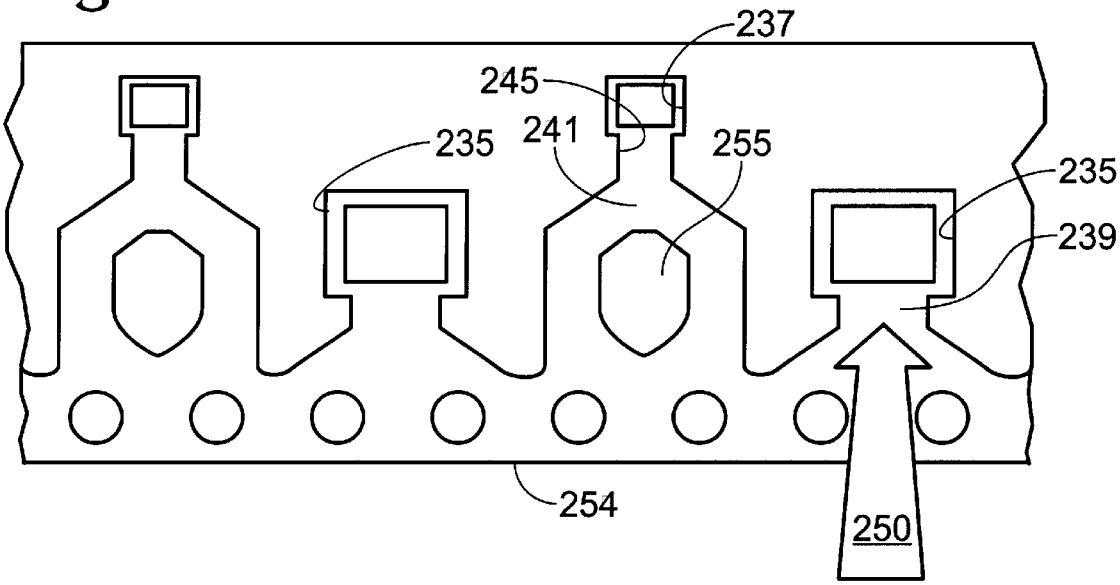
FIG. 4 is a top view, cross sectional diagram of another embodiment of the firing chambers of the present invention.

FIG. 4 depicts another preferred embodiment of the present invention wherein, unlike the embodiment of FIG. 3, the larger draft-mode firing chambers 235 and high-quality-mode firing chambers 237 are substantially fluidically isolated from one another. As before, the draft-mode firing chamber 235 is relatively close to the edge 254 across which the refill ink 250 flows as that ink moves toward the chamber 235 through the channel 239.

A high-quality-mode firing chamber 237 is located between each draft-mode firing chamber 235. As before, the ink channel 241 and associated restricted portion 245 are shaped to enhance passive damping of the ink flow from the edge 254 to the high-quality-mode firing chamber 237. To this end, the high-quality-mode firing chamber 237 is remote from the edge 254, as compared to the draft-mode firing chamber 235. In this embodiment, a flow-dividing, generally elliptical island 255 is located in the channel for defining two branches of the channel 241 that converge at the channel restriction 245.

It will be appreciated by one of ordinary skill without undue experimentation that the precise dimensions of the firing chamber and ink channel configurations can be optimized, for example, to achieve the degree of print quality sought in the high-quality-mode and the printing speed sought for the draft mode. It is the provision of separate, print-mode specific firing chambers in accord with the present invention that frees the designer from compromising the performance of one print mode to avoid deleterious effects on the other.

Inasmuch as the high-quality-mode firing chambers 137, 237 can be dedicated to high-quality mode printing, it is also contemplated that the nozzle geometry for such printing can be optimized for such chambers in order to optimize the shape of the expelled drops. For instance, with reference to FIG. 2, a high-quality-mode nozzle (that is, a nozzle 18 that is adjacent to a high-quality-mode firing chamber) could be more severely tapered (as illustrated in dashed lines 218) than a draft-mode nozzle. Again, the use of two different firing chamber configurations permits this design flexibility.

Having here described preferred embodiments of the present invention, it is anticipated that other modifications may be made thereto within the scope of the invention by individuals skilled in the art. Thus, although preferred and alternative embodiments of the present invention have been described, it will be appreciated that the spirit and scope of the invention is not limited to those embodiments, but extend to the various modifications and equivalents as defined in the appended claims.

What is claimed is:

1. An ink-jet printhead comprising:

a substrate;

a first firing chamber and a second firing chamber on the substrate, both chambers being configured for receiving ink that flows into the chambers;

a heat transducer located within the first firing chamber, and a heat transducer located within the second firing chamber; wherein the first and second firing chambers are in fluid communication to permit ink to flow through the first firing chamber and into the second firing chamber.

2. The printhead of claim 1 wherein the first firing chamber is larger than the second firing chamber.

3. The printhead of claim 1 wherein the substrate has an edge across which ink flows into the chambers and wherein the first firing chamber is closer to the edge than is the second firing chamber.

4. The printhead of claim 3 wherein the first and second firing chambers are aligned to facilitate substantially linear flow of ink from the edge to the second firing chamber.

5. The printhead of claim 3 further comprising a channel through which ink flows from the edge to the first and second firing chambers, the channel including a first restriction portion between the edge and the first firing chamber and a second restriction portion between the edge and the second firing chamber, the second restriction portion being smaller than the first restriction portion.

6. The printhead of claim 1 including an ink-jet printer cartridge to which the printhead is mounted.

7. The printhead of claim 1 further comprising a nozzle plate mounted to the printhead and having a first tapered nozzle in fluid communication with the first firing chamber and a second tapered nozzle in fluid communication with the second firing chamber, and wherein the amount of taper of the first nozzle is different from the amount of taper of the second nozzle.

8. The printhead of claim 1 further comprising discrete conductive members connected to the heat transducers thereby to facilitate independent operation of the heat transducers.

9. A method of configuring firing chambers on the substrate of an ink-jet printhead, wherein the printhead has a slot from which ink flows through channels and into each of the firing chambers for expulsion therefrom by a heat transducer located in each chamber, comprising the steps of:

locating a first firing chamber on the substrate at a first position relative to the slot;

locating a second firing chamber on a substrate at a second position that is farther from the slot than the first position;

sizing the second firing chamber to be smaller than the first firing chamber; and sizing the channels so that the rate of ink flow into the first firing chamber is greater than the rate of ink flow into the second firing chamber.

10. The method of claim 9 including the step of connecting the first and second firing chambers so that ink can flow through the first firing chamber into the second firing chamber.

11. The method of claim 10 wherein the locating steps include aligning the first and second firing chambers along a linear path that is substantially perpendicular to the slot.

12. The method of claim 9 including the step of providing a nozzle plate located such that each of the first and second firing chamber has an adjacent tapered nozzle through which ink drops are expelled, and further comprising the step of tapering the nozzle that is adjacent to the first firing chamber by an amount different from that of the nozzle that is adjacent to the second firing chamber.

13. A method of configuring firing chambers on the substrate of an ink-jet printed, wherein the printhead has a slot from which ink flows through channels and into each of the filing chambers for expulsion therefrom by a heat transducer located in each chamber, comprising the steps of:

locating a first firing chamber on the substrate at a first position relative to the slot;

locating a second firing chamber on a substrate at a second position that is farther from the slot than the first position;

sizing, the channels so that the rate of ink flow into the first firing chamber is greater than the rate of ink flow into the second firing chamber;

providing a heat transducer in the first firing chamber and providing a heat transducer in the second firing chamber, the heat transducers being operable at different frequencies thereby to permit selection of a fast print mode and a slower print mode for ejecting drops of ink from the firing chambers; and connecting separate conductive members to each heat transducer thereby to permit independent operation of the two heat transducers.

14. The method of claim 13 including the step of operating only the heat transducer in the first chamber in instances where the fast print mode is selected.

15. An ink-jet printhead for ejecting ink drops onto adjacent media, comprising:

a substrate having an edge across which ink flows; and a first firing chamber and a second firing chamber on the substrate, each chamber configured for receiving a volume of ink to be expelled therefrom by a heat transducer, wherein the first firing chamber is larger than the second firing chamber and wherein the first firing chamber is closer to the edge than is the second firing chamber.

16. The printhead of claim 15 wherein the first and second firing chambers are connected by a channel so that ink flowing to the second firing chamber must pass through the first firing chamber.

17. The printhead of claim 15 further comprising a first channel connected to the first firing chamber and through which ink flows into the first firing chamber, and a second channel connected to the second firing chamber and through which ink flows into the second chamber, the first channel being configured so that ink flows through it a rate greater than the ink flows through the second channel.

18. The printhead of claim 15 further comprising a nozzle plate mounted to the printhead and having a first tapered nozzle in fluid communication with the first firing chamber and a second tapered nozzle in fluid communication with the second firing chamber, and wherein the amount of taper of the first nozzle is different from the amount of taper of the second nozzle.

19. The printhead of claim 15 wherein the first and second firing chambers are linearly aligned in a direction that is perpendicular to the edge.

20. A method of configuring firing chambers on the substrate of a fluid ejection device, wherein the substrate has a slot from which fluid flows through channels and into each of the firing chambers for expulsion therefrom by a heat transducer located in each chamber, comprising the steps of:

locating a first firing chamber on the substrate at a first position relative to the slot;

locating a second firing chamber on a substrate at a second position that is farther from the slot than the first position;

sizing the second firing chamber to be smaller than the first firing chamber; and sizing the channels so that the rate of fluid flow into the first firing chamber is greater than the rate of fluid flow into the second firing chamber.

21. A method of configuring firing chambers on the substrate of a fluid ejection device, wherein the substrate has a slot from which fluid flows through channels and into each of the firing chambers for expulsion therefrom by a heat transducer located in each chamber, comprising the steps of:

locating a first firing chamber on the substrate at a first position relative to the slot;

locating a second firing chamber on a substrate at a second position that is farther from the slot than first position;

sizing the channels so that the rate of fluid flow into the first firing chamber is greater than the rate of fluid flow into the second firing chamber;

providing a heat transducer in the first firing chamber and providing a heat transducer in the second firing chamber, the heat transducers being operable at different frequencies thereby to permit selection of a first mode for ejecting drops of fluid from the firing chambers and a slower, second mode for ejecting drops of fluid from the firing chambers; and connecting separate conductive members to each heat transducer thereby to permit independent operation of the two heat transducers.

* * * * *

UNITED STATES PATENT AND TRADEMARK OFFICE

CERTIFICATE OF CORRECTION

PATENT NO. : 6,409,318 B1
DATED : June 25, 2002
INVENTOR(S) : Garrett E. Clark

It is certified that error appears in the above-identified patent and that said Letters Patent is hereby corrected as shown below:

Title page, Item [54] and Column 1, line 1,
Title, "CONFIGURATION" should read -- CONFIGURATIONS --;

Column 2,
Line 45, delete the following paragraph:

"The present invention also permits the nozzle configurations for each firing chamber to be optimized for the print mode that is carried out by that particular firing chamber. Also, the draft-mode-dedicated nozzles require much less intermittent servicing, which is automatically performed by a service station that is installed in the printer. As a result, draft mode operation is less often interrupted for servicing as compared to the high-quality mode operation, which produces better drop configurations but requires more frequent servicing."

Column 7,
Line 58, "printed" should read -- printhead --.

Signed and Sealed this

Twenty-seventh Day of May, 2003

JAMES E. ROGAN
*Director of the United States Patent and Trademark Office*